United States Patent [19]

Bowen et al.

[11] Patent Number: 4,482,448

[45] Date of Patent: Nov. 13, 1984

[54] ELECTRODE STRUCTURE FOR ELECTROLYSER CELLS

[75] Inventors: Christopher T. Bowen, Pointe Claire; H. John Davis, Beaconsfield; Rodney L. LeRoy, Pointe Claire, all of Canada

[73] Assignees: Noranda Inc.; The Electrolyser Corporation Ltd., both of Toronto, Canada

[21] Appl. No.: 420,637

[22] Filed: Sep. 21, 1982

[30] Foreign Application Priority Data

Dec. 23, 1981 [CA] Canada ..... 393109

[51] Int. Cl.[3] ..... C25B 11/03

[52] U.S. Cl. ..... 204/284; 204/286

[58] Field of Search ..... 204/284, 286, 288, 289, 204/279

[56] References Cited

U.S. PATENT DOCUMENTS

| | | | |
|---|---|---|---|
| 3,019,178 | 1/1962 | Williams | 204/284 |
| 3,123,545 | 3/1964 | Williams | 204/284 |
| 3,379,634 | 4/1968 | Rutkowski | 204/258 |
| 3,930,981 | 1/1976 | De Nora et al. | 204/284 X |
| 3,941,675 | 3/1976 | Strasser et al. | 204/256 |
| 4,008,143 | 2/1977 | Kircher et al. | 204/257 |
| 4,187,165 | 2/1980 | Appleby et al. | 204/284 X |
| 4,369,102 | 1/1983 | Galluzzo et al. | 204/228 |

FOREIGN PATENT DOCUMENTS

| | | |
|---|---|---|
| 822662 | 9/1969 | Canada . |
| 1002476 | 12/1976 | Canada . |
| 1041040 | 10/1978 | Canada . |
| 1086256 | 9/1980 | Canada . |
| 7919346 | 7/1979 | France . |

*Primary Examiner*—G. L. Kaplan
*Assistant Examiner*—Nam X. Nguyen
*Attorney, Agent, or Firm*—Fleit, Jacobson, Cohn & Price

[57] ABSTRACT

An electrode structure for electrolytic cells is disclosed. The electrode structure comprises a central current-collector structure having high points on at least one side and adapted to be placed vertically in the electrolytic cell, and a porous electrode secured to the high points of the current-collector structure on at least one side thereof so as to form an essentially-planar pre-electrode surface. The high points of the current-collector are arranged so as to allow an unimpeded rise of the evolved gases to the top of the electrode.

5 Claims, 4 Drawing Figures

ELECTRODE STRUCTURE FOR ELECTROLYSER CELLS

This invention relates to an electrode structure for electrolyser cells, more particularly of the unipolar type.

It is well known that the voltage of an electrolytic cell is the sum of three major components: the thermodynamic potential required for the overall cell reaction; the electrode overvoltages which result from kinetic limitations; and a resistive contribution to cell voltage. For a particular desired process, the major avenues open for reduction of energy requirements are electrode activation to reduce the overvoltages for the desired reactions, and design improvement to reduce resistive losses.

Resistive losses are of two types: ionic, reflecting a resistance to the passage of current in the electrolyte; and electronic, reflecting the resistance to the passage of current in current-carrying metallic components of the electrolyser. In bipolar electrolyser designs, the ionic resistance contribution is of overwhelming importance, since current paths through metallic elements are normally very short in length. In equipment of the unipolar design, however, electronic resistance losses can become substantial, as the electronic current is normally removed from each electrode to a current-removal structure.

In designing to control ionic resistance of an electrolyser, two considerations are particularly important: minimization of the distance between the anodic and cathodic electrode elements; and minimization of the quantity of evolved gases which is retained between the electrodes, increasing the effective electrolyte resistivity. This latter requirement can be particularly important in cells having gas separating elements or diaphragms, where gas may accumulate in the separator or on its surface, thus increasing its resistance.

A design approach directed at satisfying these two requirements for minimizing ionic resistance, which has come into widespread use, is to use a porous pre-electrode structure on which the gas evolves, and which allows passage of the product gases through the structure to a rear area where they can be removed. Typical pre-electrode forms are perforated plates, expanded-metal sheet, and woven metal cloth. Any suitably-porous structure can be envisaged, including grooved sheets on foam metal.

A number of designs make use of porous pre-electrodes of this type which are fabricated from material which is sufficiently strong to be used without support, and which can be attached directly to a current-removal structure at the periphery of the electrode. An example is Canadian Pat. No. 822,662, issued Sept. 9, 1969. However, these pre-electrodes do not have the current removal capacity which is required for industrial unipolar electrolyser cells.

Several inventors have recognized the desirability of using a supporting structure as part of the electrode, in order to accomplish desirable mechanical objectives. For example, Canadian Pat. No. 1,002,476 issued Dec. 28, 1976, discloses the use of a thin corrugated structure, internal to the pre-electrode, to provide a spring effect and improve the compression of anode/separator/cathode array while allowing for flexibility during cell assembly. Canadian Pat. No. 1,086,256, issued Sept. 23, 1980, features the use of a similar internal structure for the purpose of providing support to the pre-electrode when a diaphragm material is being deposited on the electrode surfaces under vacuum. However, the internal support structure of these electrodes is not connected to current removal structures and, more importantly, not designed to carry currents in the order of 1000 to 10,000 amperes or more, such as required in industrial unipolar electrolyser cells.

The pre-electrode elements are often attached to central current-collector structures, for example rods or an equivalent fabricated structure in the unipolar design as disclosed in Canadian Pat. No. 1,041,040, issued Oct. 24, 1978, or a formed bipolar plate in bipolar electrolyser equipment, as disclosed in U.S. Pat. No 3,379,634, issued Apr. 23, 1968. These electrode designs are, however, not adequate for electrolyser cells because they do not allow efficient removal of gases up the electrode. U.S. Pat. No. 4,008,143 discloses an electrode structure comprising two spaced porous pre-electrodes and a plurality of current conductive rods separately attached to each porous pre-electrode and positioned in the space between the porous pre-electrodes in such a way as to leave space for electrolyte to flow upwardly between the porous pre-electrodes. However, electrolyser cells would require a large number of current conductive rods in order for the pre-electrodes to carry currents in the order of 1000 to 10,000 amperes and more, and this would unduly restrict gas circulation between the porous pre-electrodes.

It is therefore, the object of the present invention to provide an electrode for electrolyser cells which has the following characteristics:

(a) Allows efficient removal of gases formed on the outer faces of the electrode surface to the interior of the electrode structure and up the electrode structure under the influence of their natural buoyancy in the electrolyte, thus reducing the ionic contribution to electrolyser voltage.

(b) Allows current to be removed from each electrode while minimizing electronic resistance losses.

(c) Is amenable to fabrication by low-cost techniques such as rolling, stamping and welding, thus providing an economic electrode.

(d) Allows use of low-cost materials of construction having regular surfaces which can be reliably and economically protected from corrosion in the electrolyte by the electroplating of nickel or other corrosion-resistant coatings.

(e) Has a thin profile, to be consistent with an electrolyser design for minimum size per unit of production capacity.

The electrode structure, in accordance with the present invention, comprises a central current-collector structure having high points on at least one side thereof and adapted to be placed vertically in the electrolytic cell, and a porous electrode secured to the high points of the current-collector structure on at least one side thereof so as to form an essentially-planar pre-electrode surface. The high points of the current-collector structure are located on the central current-collector so as to allow an unimpeded rise of the evolved gases to the top of the electrode.

The central current-collector is preferably a plate having vertically oriented corrugations and the pre-electrode is secured to the crest of such corrugations.

The invention will now be disclosed, by way of example with reference to the accompanying drawings in which.

Figure 2:
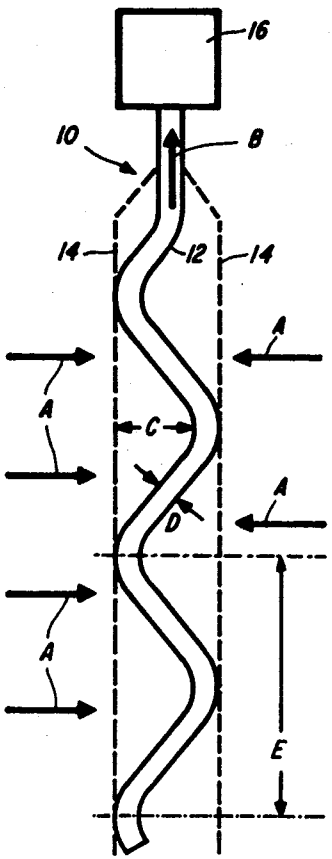
FIG. 2 is a plan view of a portion of the electrode of FIG. 1.
Figure 1:
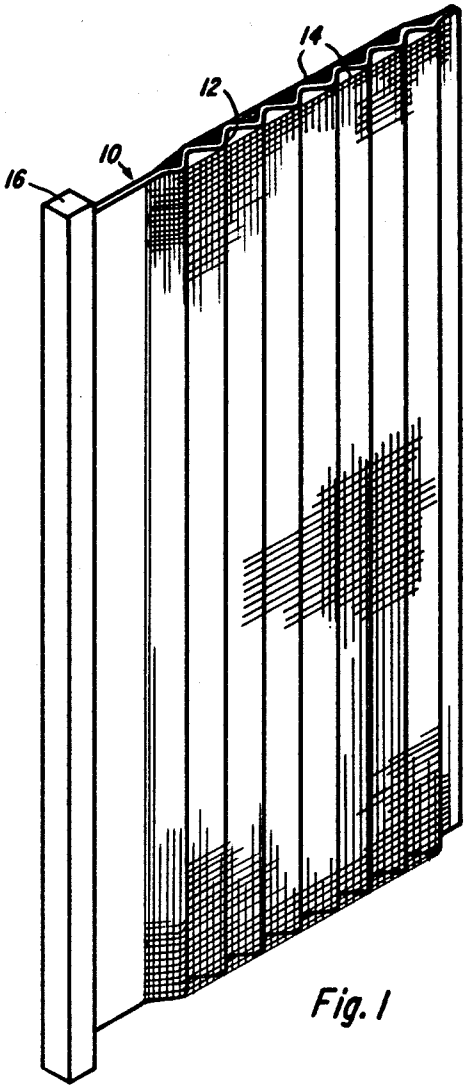
FIG. 1 is a perspective view of an electrode in accordance with the invention.

Referring to FIGS. 1 and 2 of the drawings, there is shown a gas evolving electrode 10, anode or cathode which comprises a central current collector 12 to each side of which is attached a pre-electrode 14. Ionic current flow from the adjacent electrode or electrodes of opposite polarity would flow to the electrode perpendicular to the pre-electrode structures, as shown by arrows A, and current is removed from the pre-electrodes by the current collector 12, as indicated by arrow B.

The pre-electrodes are normally woven screen, expanded metal, or perforated plate but can be of any other perforated or porous geometry which allows for gas passage through the structure to the interior of the electrode.

The central current-collector is a solid, formed metal piece which is illustrated as being corrugated, although any structure which could be formed in an economic manner, and which allows for unimpeded rise of the evolved gases to the top of the electrode, would be within the scope of the invention.

The pre-electrode is attached to the central current collector at the high points of the structure so as to form an essentially-planar pre-electrode surface. The attachment may be by a weld, by screws or other mechanical fasteners, or by pressure which is exerted by the composite electrode/separator mass.

The central current collector must be attached at one end to the elements removing current from the electrode. This attachment may be continuous, through a welded, bolted, or riveted contact, or it may be at several points through connections to suitable conductors. In this latter case, additional current-conducting material may be included in the structure, as indicated by bar 16, to assist current equalization in the vertical direction, to further minimize resistive losses.

In any particular electrolyser design, the parameters of the electrode of this invention are established by an optimization which considers the resistive losses in the structure, the cost of the material of construction, and the physical constraints imposed by the detailed electrolyser design on maximum and minimum electrode thickness. It has been surprisingly found that a depth of the corrugations C (FIG. 2) as low as 0.16 cm is satisfactory for electrode heights as great as 75 cm, with gas evolution at current densities to 1,000 mA/cm$^2$; no increase in the ionic-resistance factor of the electrolyser was detectible with increasing current density, suggesting that the product gas is being effectively removed to the interior of the electrode structure. However, the depth of corrugations would likely not be less than 0.1 cm. The maximum depth of corrugation would be established by practical constraints on electrolyser size; it would be unlikely that a depth of corrugation greater than 3 cm would be desirable.

The thickness D (FIG. 2) of the current collector material may be between 0.04 and 1.5 cm depending on the amount of current to be removed from the electrode. The length E (FIG. 2) of the corrugation waves, or the spacing of the high points of equivalent formed structures, will be the minimum consistent with economic forming of the current-collector material. This is necessary to minimize resistance losses in the pre-electrode structure. The length of corrugation might be between 0.7 and 15 cm for a current-collector material having a thickness of between 0.04 and 1.5 cm.

Other dimensions of the current-collector structure can be established through a detailed optimization to minimize total operating cost, including capital amortization. Each of the major electrode parameters can be optimized in this way: thickness of the material from which the current collector is formed, width of the electrode, and, depending on the detailed method being used for current removal, dimensions of the current equalization or removal bar 16 and the electrode height.

Figure 3:
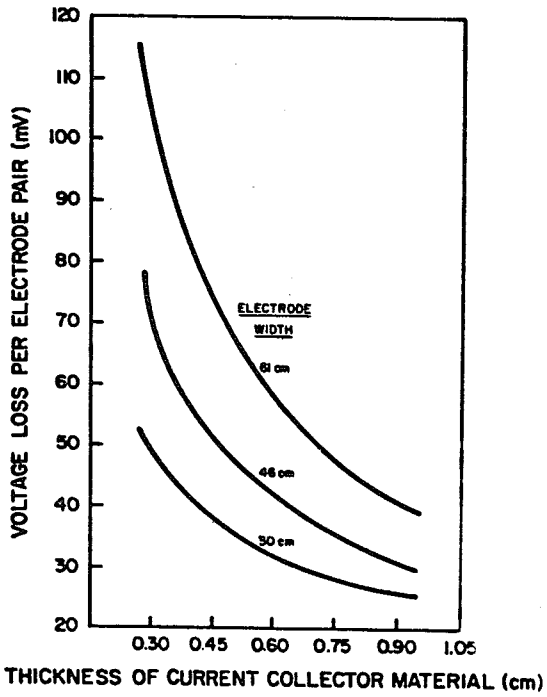
FIGS. 3 and 4 illustrate typical optimization curves for an electrode from which current is being removed uniformly at the side.
Figure 4:
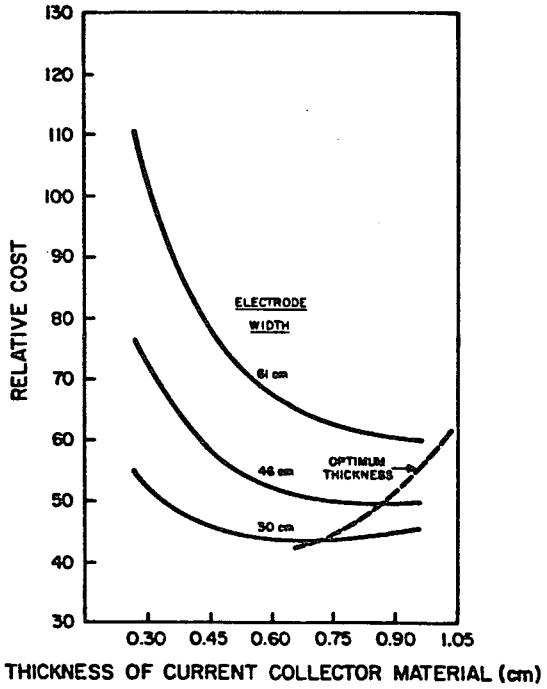

FIGS. 3 and 4 illustrate a typical optimization, for an electrode from which current is being removed uniformly at the side. The anode and cathode are assumed to be of similar design. The contribution to cell voltage due to electronic resistance of the current-collector structure (FIG. 3) diminishes as the thickness of the current-collector material is increased, or as the width of the electrode is reduced. Such voltage contributions can be calculated unambiguously by the method described by R. O. Loutfy and R. L. LeRoy in the Journal of Applied Electrochemistry 8 (1978) pages 549–555. The results presented assume that the material of construction is mild steel at 70° C., and that the current density on the projected pre-electrode structure is 240 mA/cm$^2$.

FIG. 4 shows a typical optimization, in this case assuming a current price for mild steel and a power cost of \$0.03/kWh. The optimum electrode thickness is seen to increase with increasing electrode width. Of course the optimum values indicated by calculations such as these will have to be modified based on other considerations related to the overall dimensions of the electrolyser, the method of current removal, etc.

It must be noted that the formed current-collector structures of this invention are in no way related to formed structures described in the prior art, which have been used for mechanical purposes such as compression of the electrode mass. The electrodes of this invention are designed to carry currents of 1,000 to 10,000 amperes and more, and precise specification of the current-removal provisions is essential to achieve an economic result. Similarly, the massive quantities of gas evolved at such current loadings must be free to move unimpeded up the electrode to escape at the top. None of the proposals of the prior art accomplish these two objectives.

We claim:

1. An electrode structure for unipolar electrolytic cells comprising:

(a) a formed metal plate current-collector structure having vertically orientated corrugations which define a plurality of respective crests and adapted to be placed vertically in the electrolytic cell;

(b) a porous electrode secured to the crests of said corrugations on at least one side thereof so as to form an essentially-planar pre-electrode surface, the depth of said corrugations being such as to allow an unimpeded vertical rise of evolved gases to the top of the electrode between the corrugated plate and the pre-electrode surface; and (c) means for removing or applying current from one vertical end edge of said plate.

2. An electrode structure as defined in claim 1 wherein said means for removing current from one vertical end edge of said plate includes a bar secured to said vertical end edge for current equalization.

3. An electrode structure as defined in claim 1 or 2 wherein the depth of corrugation of the electrode is between 0.1 and 3 cm.

4. An electrode structure as defined in claims 1 or 2 wherein the thickness of said plate is between 0.04 and 1.5 cm.

5. An electrode structure as defined in claim 4, wherein the length of said corrugations is between 0.7 and 15 cm for a plate having a thickness of between 0.04 and 1.5 cm.

* * * * *